US009453333B2

(12) United States Patent
Porter

(10) Patent No.: US 9,453,333 B2
(45) Date of Patent: Sep. 27, 2016

(54) SYSTEM AND METHOD OF FABRICATING AND ASSEMBLING INDUSTRIAL PLANT MODULES FOR INDUSTRIAL PLANT CONSTRUCTION

(71) Applicant: Ronald Porter, Calgary (CA)

(72) Inventor: Ronald Porter, Calgary (CA)

( * ) Notice: Subject to any disclaimer, the term of this patent is extended or adjusted under 35 U.S.C. 154(b) by 0 days.

(21) Appl. No.: 14/469,737

(22) Filed: Aug. 27, 2014

(65) Prior Publication Data

US 2016/0060860 A1 Mar. 3, 2016

(51) Int. Cl.

| | |
|---|---|
| ***E04B 1/00*** | (2006.01) |
| ***E04B 1/348*** | (2006.01) |
| ***E04B 1/342*** | (2006.01) |
| ***E04G 21/14*** | (2006.01) |
| ***E04H 5/02*** | (2006.01) |

(52) U.S. Cl.

CPC ..... *E04B 1/348* (2013.01); *E04B 1/342* (2013.01); *E04G 21/14* (2013.01); *E04H 5/02* (2013.01)

(58) Field of Classification Search

CPC ..... E04B 1/342; E04B 1/348; E04G 21/14
USPC ..... 52/79.1, 79.4, 79.5, 79.13, 125.2, 52/167.1, 747.1
See application file for complete search history.

(56) References Cited

U.S. PATENT DOCUMENTS

| | | | | |
|---|---|---|---|---|
| 2,499,498 | A * | 3/1950 | Hammond, Jr. | 52/67 |
| 3,455,075 | A * | 7/1969 | Frey | 52/79.7 |
| 3,568,380 | A * | 3/1971 | Stucky | E04B 1/22 52/223.13 |
| 3,638,380 | A * | 2/1972 | Perri | 52/79.12 |
| 3,738,069 | A * | 6/1973 | Navarrette-Kindelan | 52/73 |
| 3,742,660 | A * | 7/1973 | Bierweiler | 52/79.13 |
| 3,820,664 | A * | 6/1974 | Lewis et al. | 414/141.3 |
| 3,890,748 | A | 6/1975 | Fencl | |
| 3,958,320 | A | 5/1976 | van der Lely | |
| 3,962,773 | A | 6/1976 | van der Lely | |
| 3,971,175 | A * | 7/1976 | Boel et al. | 52/79.1 |
| 3,994,060 | A | 11/1976 | van der Lely et al. | |
| 4,054,014 | A * | 10/1977 | van der Lely | 52/745.03 |
| 4,184,296 | A * | 1/1980 | Vitalini | 52/79.4 |
| 4,195,453 | A * | 4/1980 | Komendant | 52/79.13 |
| 4,408,434 | A * | 10/1983 | Collins | E04B 1/35 52/236.3 |
| 4,435,927 | A * | 3/1984 | Umezu | E04B 1/3483 52/235 |
| 4,586,299 | A * | 5/1986 | Bayer | E04B 1/348 52/79.7 |
| 4,593,498 | A * | 6/1986 | Stauss et al. | 52/18 |
| 4,807,407 | A | 2/1989 | Horn | |
| 6,959,515 | B1 * | 11/2005 | Beighton | 52/79.9 |
| 8,151,537 | B2 | 4/2012 | Pope | |
| 8,381,453 | B2 | 2/2013 | Lim | |
| 8,397,441 | B2 | 3/2013 | Wallance | |
| 8,474,194 | B2 * | 7/2013 | Tiramani | 52/79.5 |
| 8,739,477 | B2 * | 6/2014 | Kaiser | 52/167.1 |
| 9,068,340 | B2 * | 6/2015 | Austin et al. | |

(Continued)

*Primary Examiner* — James Buckle, Jr.
(74) *Attorney, Agent, or Firm* — Stephen Lewellyn; Kyle Chapin; Maxey Law Office, PLLC

(57) ABSTRACT

A method of fabricating an industrial plant module for industrial plant construction includes (1) determining a number of single level layers required to fabricate a multi-story industrial plant module, including at least two story layers; (2) constructing the single level layers at substantially ground level and in a multi-step sequence, including installing equipment on at least one story layer, and where each story layer is open at its top; and (3) fabricating the multi-story industrial module by stacking the single level layers and fastening the single level layers together.

10 Claims, 6 Drawing Sheets

(56) References Cited

U.S. PATENT DOCUMENTS

| | | | | |
|---|---|---|---|---|
| 2003/0230031 | A1 | 12/2003 | Lam | |
| 2008/0127662 | A1 | 6/2008 | Stanfield | |
| 2010/0058675 | A1* | 3/2010 | Simmons | 52/79.1 |
| 2011/0146164 | A1 | 6/2011 | Haney et al. | |
| 2011/0214361 | A1* | 9/2011 | Ingjaldsdottir et al. | 52/79.1 |
| 2011/0252718 | A1 | 10/2011 | Kobayashi | |

* cited by examiner

SYSTEM AND METHOD OF FABRICATING AND ASSEMBLING INDUSTRIAL PLANT MODULES FOR INDUSTRIAL PLANT CONSTRUCTION

FIELD OF THE INVENTION

The present invention relates generally to modular construction of process plants, and more particularly, relating to a method of constructing multi-story industrial plant modules in single layers and then stacking the layers together to fabricate the industrial plant module

BACKGROUND OF THE INVENTION

Modular construction of process plants and other industrial process facilities is known. Generally, modular construction involves building numerous separate modules at a fabrication site, transporting the modules from the fabrication site to the plant site, and then coupling the modules together at the plant site to erect the process plant. Modular construction is use to construct process plants worldwide in many onshore and offshore applications, including, but not limited to petroleum processing and refining, chemical processing, mineral processing, and forest product processing.

Conventionally, modules are fabricated by fastening structural members, such as steel beams, together to create a three-dimensional, skeleton-like frame. The frame is generally a multi-story rectangular grid of connected vertical and horizontal beams forming the module. The frame is usually constructed outdoors in a prepared industrial yard, commonly called a "module yard" or "mod yard" for short. Large mod yards can range up to a hundred hectares with dozens of portable cranes, and workforces as large as 1,000 members.

After the frame is fabricated, it is moved to a location in the mod yard and supported on blocks, typically 1 m high. Temporary ladders, scaffolding, and/or platforms are erected so workers can climb to locations within the frame to install permanent walkways (if included) and piping and/or other equipment mounts and supports. Afterwards, piping and other equipment are installed, followed by insulating the liquid carrying components and various electrical and instrumentation systems.

Cranes are required to lift the various lengths of pipe and other equipment up and into the frame and place them as close as possible to the position of where they will be installed. Positioning the equipment in the frame at the installation location is limited by the vertical and horizontal beams that make up the frame. Additionally, temporary or permanent lighting may be setup around the yard to allow performing work at night. And tarpaulins and portable heaters may be used to limit worker exposure to inclement weather.

The size and configuration of each module depends on the functional requirements of the related portion of the process plant where the module will be installed. Often the modules are designed to be as large as the highway transportation network will allow. For example, modules can be 7.3 m wide, 7.3 m high, and 40 m long, and weighing up to 150.00 kg. The typical time to construct a module can vary considerably depending on the scope of work required, as well as workforce availability. A typical target is four to eight weeks depending on the module.

While modularized plant construction is desirable because of significantly reduced construction costs and reduced time to complete construction that are realized with modularized plant construction, there are many drawbacks to current modularized construction methods. Most of the drawbacks relate to initially constructing the individual modules in multistory frames and then relocating the modules for installing equipment. This method of construction reduces worker efficiency and raises the risk of job-site accidents due to many factors.

These factors include significant costs and safety risks in moving multi-story steel structures within large and congested mod yards. These factors also include the time needed to setup temporary ladders, stairs, and scaffolding that is required for workers to perform work on the frame. Additionally, frequently climbing ladders, stairs, and scaffolding contributes to worker fatigue and accidents, especially when work is performed during inclement weather or at night.

Further, all work is performed outside all across the mod yards, and completion of the work is subject to bad weather conditions including temperature and precipitation. Additionally, often workers are required to walk considerable distances from their marshalling point to a location at the mod yard to perform work. This walking may be through mud, snow, or ice.

Further yet, multiple cranes and highly skilled operators are required for many of the crews to place and move heavy equipment while weaving the equipment through the openings of the module's skeleton frame in order to place the equipment. And work that is performed simultaneously on multiple levels of frame at times must be stopped to prevent injury from tools or equipment falling on workers below. Also, any tools or equipment that fall could fall in mud or snow, risking loss or damage.

SUMMARY OF THE INVENTION

An improved method and system for fabricating and assembling large equipment modules for industrial plant construction are described. The method and system of the present invention overcome the disadvantages of current modularized industrial plant construction methods by increasing efficiency and lowering risk.

Embodiments of the invention include fabrication of a multi-story industrial construction module for industrial plant construction in single layers that are then stacked and fastened together to fabricate the multi-story industrial module. The modules are designed and built in series of multiple layers at substantially ground level. Methods include constructing the models in a stepwise manner beginning with fabricating the Skelton frame of each layer and finishing with equipment installed on the frame prior to the layer being stacked together with other layers of the industrial plant module.

In general, in one aspect, a method of fabricating modules for industrial plant construction includes:

a) determining a number of single level layers required to fabricate a multi-story industrial plant module, including at least two story layers;

b) constructing the single level layers at substantially ground level including installing equipment on at least one story layer, and where each story layer is open at its top; and c) fabricating the multi-story industrial module by stacking the single level layers and fastening the single level layers together.

In general, in another aspect, a method of fabricating modules for industrial plant construction includes:

a) determining a number of single level layers required to fabricate a multi-story industrial plant module, including at least two story layers;

b) constructing the single level layers at substantially ground level and in a multi-step sequence, including installing equipment on at least one story layer, and where each story layer is open at its top; and c) fabricating the multi-story industrial module by stacking the single level layers and fastening the single level layers together.

In general, in yet another aspect, a method of fabricating modules for industrial plant construction includes:

a) determining a number of single level layers required to fabricate a multi-story industrial plant module, including at least two story layers;

b) constructing each single level layer at substantially ground level in a building facility and in a multi-step sequence, including installing equipment on each story layer, and where each story layer is open at its top; and c) fabricating said multi-story industrial module by stacking the single level layers and fastening the single level layers together after said constructing step.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there are illustrated embodiments of the invention.

BRIEF DESCRIPTION OF THE DRAWINGS

The following drawings illustrate by way of example and are included to provide further understanding of the invention for the purpose of illustrative discussion of the embodiments of the invention. No attempt is made to show structural details of the embodiments in more detail than is necessary for a fundamental understanding of the invention, the description taken with the drawings making apparent to those skilled in the art how the several forms of the invention may be embodied in practice. Identical reference numerals do not necessarily indicate an identical structure. Rather, the same reference numeral may be used to indicate a similar feature of a feature with similar functionality. In the drawings.

DETAILED DESCRIPTION OF THE INVENTION

Figure 1:
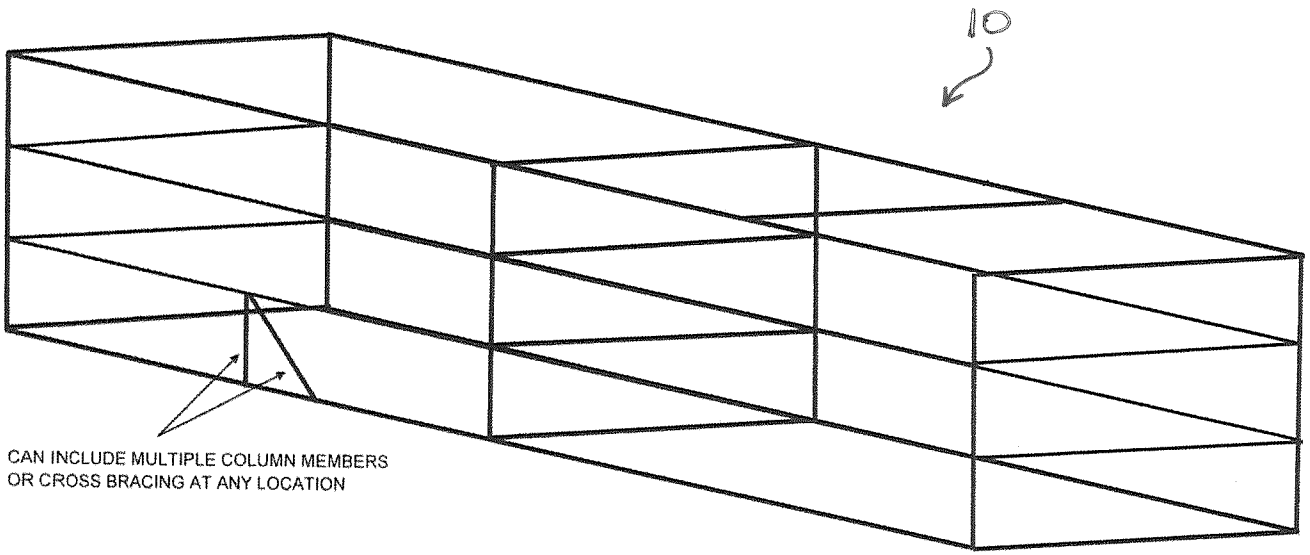
FIG. 1 is a diagrammatic view of a multi-story industrial plant module for constructing an industrial plant.

With reference to FIG. 1, there is schematically illustrated a multi-story module 10 for use in connection with modularized construction of an industrial process plant. For clarity, module 10 is illustrated without the various process piping, equipment, platforms, etc. that would be installed on the module as required for the industrial process plant. In application several modules 10 are fabricated and then transported to the site of the industrial process plant, where they are assembled together in a predetermined arrangement to construct the industrial process plant. The present invention is directed toward a system and method of fabricating the multi-story module 10 in individual layers and then assembling the individual layers to construct the larger, multi-story module 10 that is used in constructing the industrial process plant.

Figure 2:
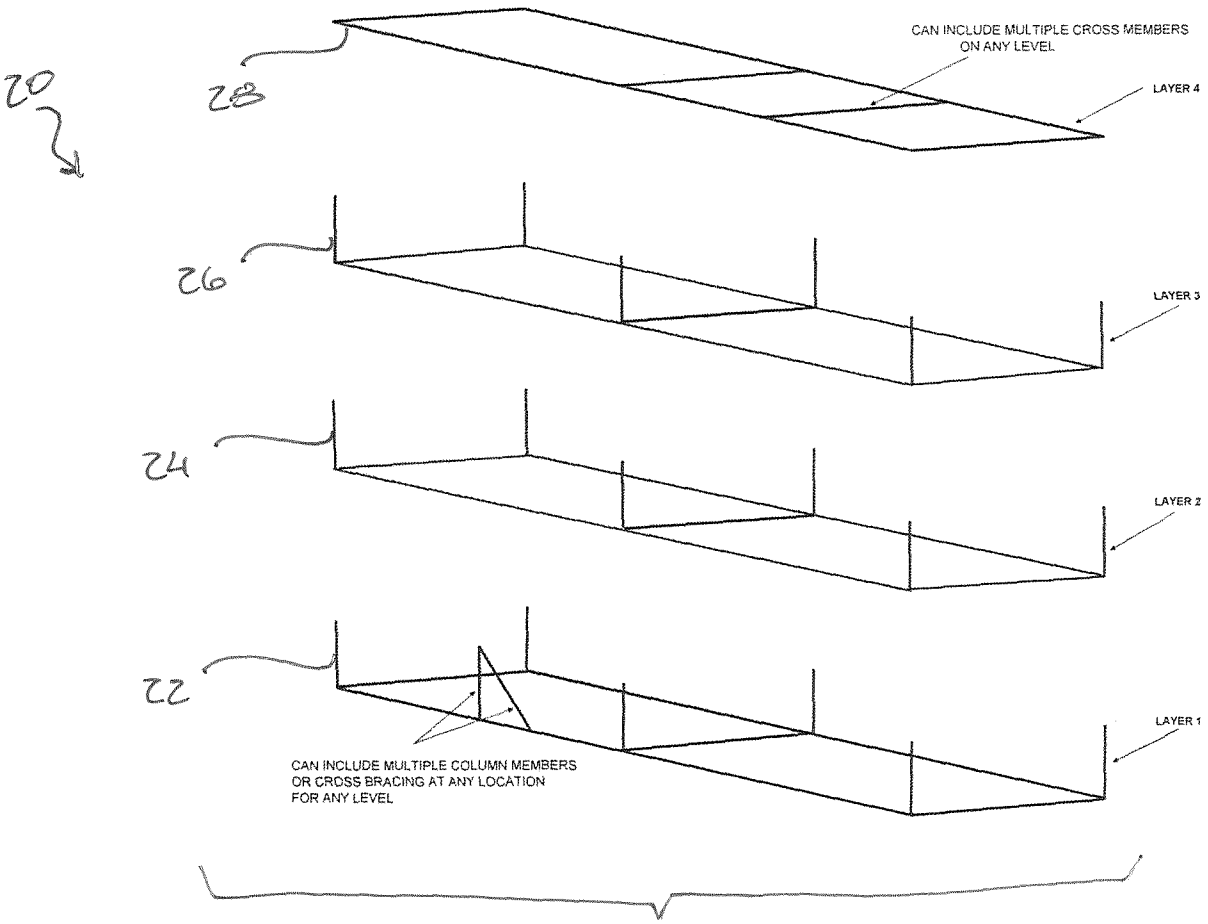
FIG. 2 is a diagrammatic view of a multi-layer system for constructing a multi-story industrial plant module.

With reference to FIG. 2, there is schematically illustrated a layered construction 20 for fabricating a multi-story module 10. Representatively illustrated is a four layer construction including layers 22-28 for fabricating a three-story module. Layers 22-26 each constitute the three stories of the module, respectively, and for clarity are illustrated without installed process plant equipment. Layer 28 is the top or roof panel of the module. While three story layers 22-26 are illustrated, the invention is not limited to only three stories, and more or less story layers could be used to fabricate a multi-story module.

As illustrated, each story layer 22-26 has several structural members that are connected together to form a skeleton frame that is open at its top. Particularly, each story layer includes several connected horizontal structural members, a plurality of vertical structural members, and may include required cross bracing members (only illustrated on layer 22). Importantly, none of the story layers 22-26 include structural members that extend across a top side of the frame. As described further below, this is important because it permits installing equipment on each story layer by hoisting the equipment directly down from above to the position the equipment in its installation location, which is installed before the layers 22-28 are connected together in a vertical stack arrangement to fabricate the module.

A benefit of the layered construction of an industrial plant module according to the present invention is the ability to transport individual layers during times of the year when transporting a complete multi-story industrial module would be prohibited by load restrictions. Following the winter season, it is common for jurisdictions in northern regions to increase load restrictions on roads while the ground thaws, which typically lasts between four and eight weeks. The weight of a completed multi-story industrial module prevents it from being transported during this ground-thawing period. This can cause delaying progress at the plant construction site. And it can cause the need for significant overtime to rush completion of the module so that it can be transported before the ground-thawing periods, which substantially increases construction costs due to costly overtime wages of skilled workers. Additionally, certain remote locations have other road restrictions such as important wildlife migration periods, which raise the same consequences.

Using layered construction of the industrial plant modules allows each layer to be transported separately to the plant construction site, where they can then be stacked together to complete the module. This allows transporting the lighter layers during the ground-thawing period so that construction is allowed to continue, which reduces construction delays and construction costs due to overtime wages.

Another benefit of the layered construction of an industrial plant module according to the present invention is the ability to install equipment on each layer separately from another layer. A common issue with heavy industrial construction is delayed delivery of specialized equipment that might have order times of 12 months or more. Delayed equipment delivery often results in having to install the equipment on the module after substantial completion of the module, which requires maneuvering the equipment around numerous piping and other equipment without damaging those components. The maneuvering is slow, expensive, and has the potential of damaging other expensive components.

Using layered construction of the industrial plant modules allows each layer to be completed separately of the other layers, which provides the ability to install late arriving equipment into the required layer before stacking and fastening the layers together. Once the late arriving equipment is installed into the required layer, overlying layers would be fastened together. This prevents the conventional practice of having to maneuver the equipment around and between various stories of the industrial module.

Figure 3:
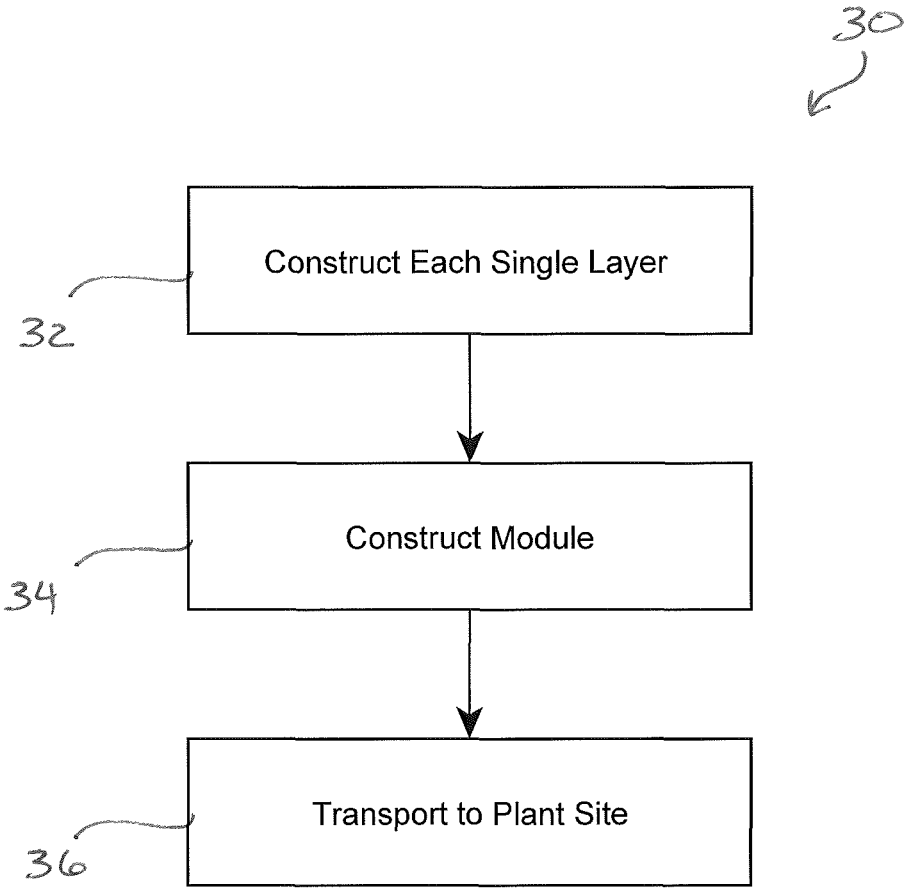
FIG. 3 is a flow chart illustrating a method of fabricating a multi-story industrial plant module.

With reference to FIG. 3, a flow-chart 30 of a method of fabricating module 10 comprising system 20 is illustrated. Beginning at step 32, all of the individual layers (e.g., 22-28 of system 20) are fabricated, including installing the required equipment. At step 34, the individual layers are placed on top of each other and fastened together to create the multi-story module 10 comprised of system 20. At step 36, the module 10 is transported to the plant site for joining with additional modules to construct the industrial process plant. Of course, the module 10 may be stored after fabrication and prior to transport to the plant site.

Figure 4:
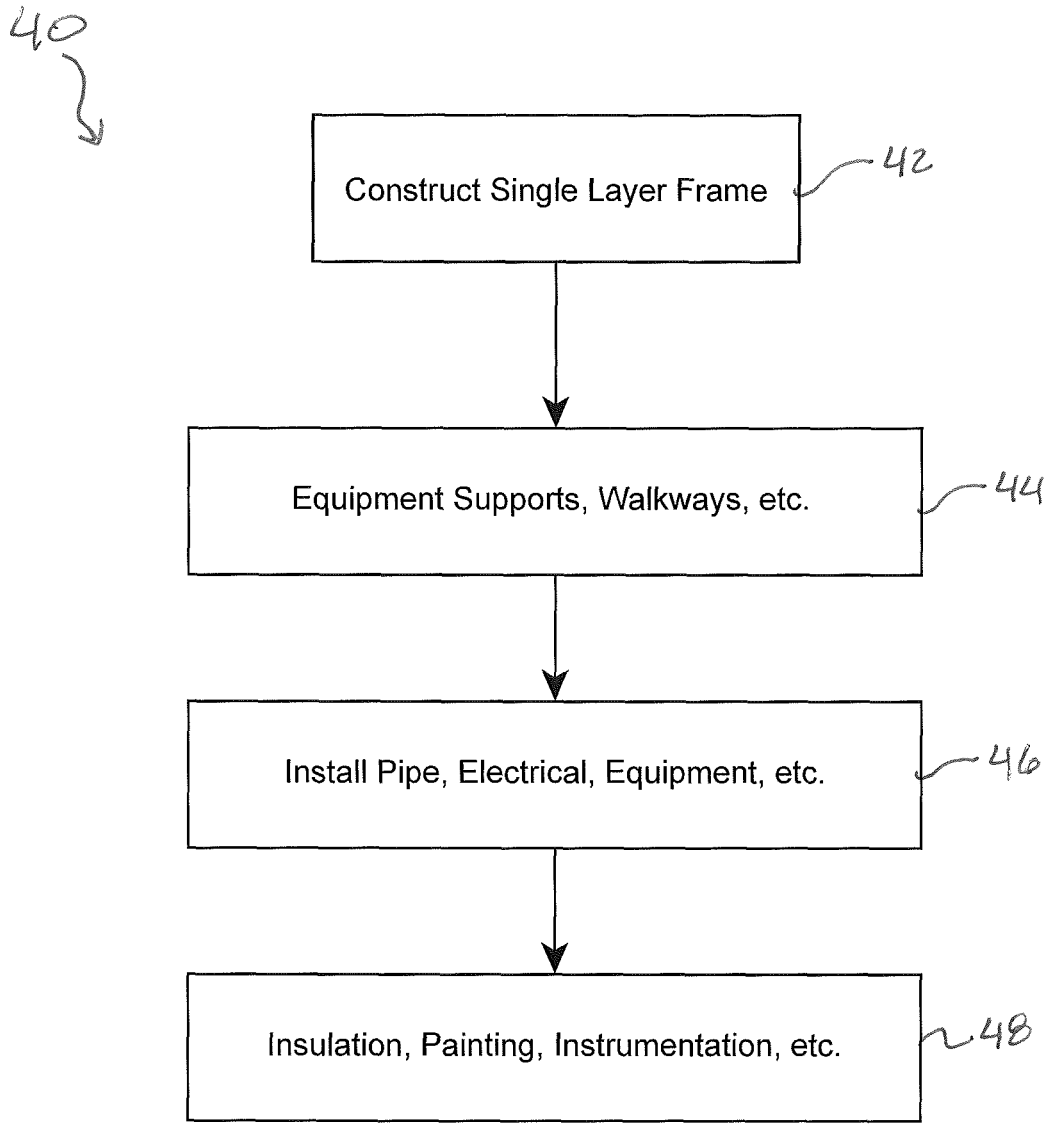
FIG. 4 is a flow chart illustrating a stepwise method of constructing a single layer of a multi-story industrial plant module.

With reference to FIG. 4, a flow-chart 40 of a method of fabricating the individual layers of system 20 of module 10 in a stepwise method is illustrated, which can be performed in step 32 described above. At step 42, the skeleton frame of a single layer is fabricated at or near ground level. Also the elevation of the layers during fabrication can be set so as to provide the most efficient and ergonomically desirable height for the work to be performed. At step 44, various equipment supports, walkways, railings, stairs, etc. are attached or otherwise secured to skeleton frame according to the industrial process plant design. At step 46, the various equipment, electrical wiring, and piping are attached or otherwise secured to the skeleton frame according to the industrial process plant design. Then, at step 48, required insulation is installed, painting is completed, and instrumentation are installed or otherwise completed according to the industrial process plant design. Once the individual layers are fabricated, they stacked and fastened together, as in step 34, to fabricate the multi-story module 10.

Figure 5:
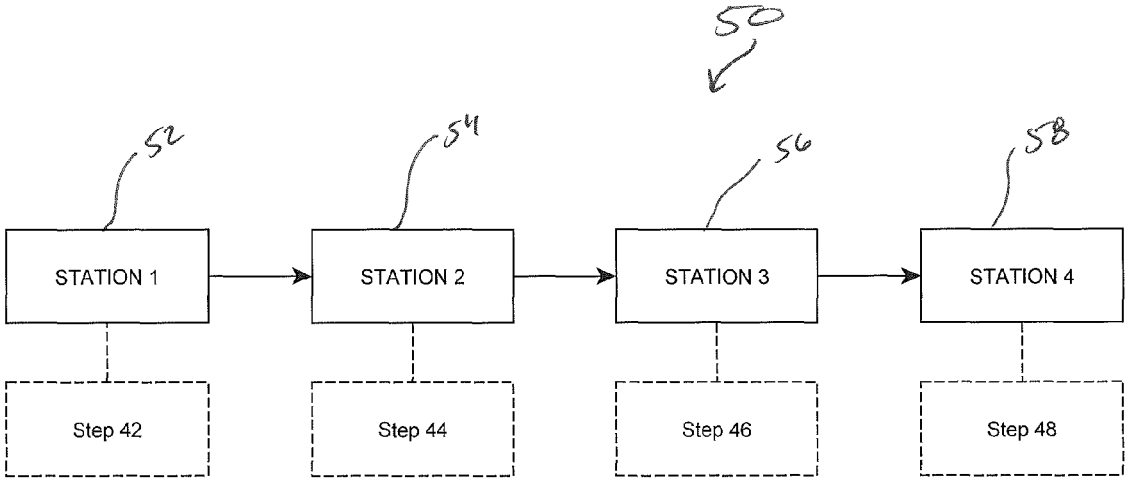
FIG. 5 is a block diagram of a linear construction system and method of constructing layers of a multi-story industrial plant module.

To maximize efficiency, module layers 22-28, for example, can be fabricated at separate work stations where specific scope(s) of work can be performed. In FIG. 5, there is diagrammatically illustrated a linear fabrication system 50 for constructing the layers of system 20 and module 10, and in accordance with the methods disclosed herein. As a non-limiting example, the fabrication system 50 includes four fabrication stations 52-58. Where, for example, at the first station 52, step 42 is performed. At the second station 54, step 44 is performed. At the third station 56, step 46 is performed. And then at the fourth station 58, step 48 is performed. The layers would be held at each station for a period of time to allow completion of the work required. The stations could be arranged within a building structure as opposed to outside, where the work is subject to inclement weather. In such an arrangement, the layers could be moved between stations using a track system and/or overhead travelling bridge crane system, which would further increase productivity and safety of the work being performed.

Alternatively, several master work stations could be set-up, one for each layer, where all of the work to be performed on a respective layer is completed with the layer held stationary.

Figure 6:
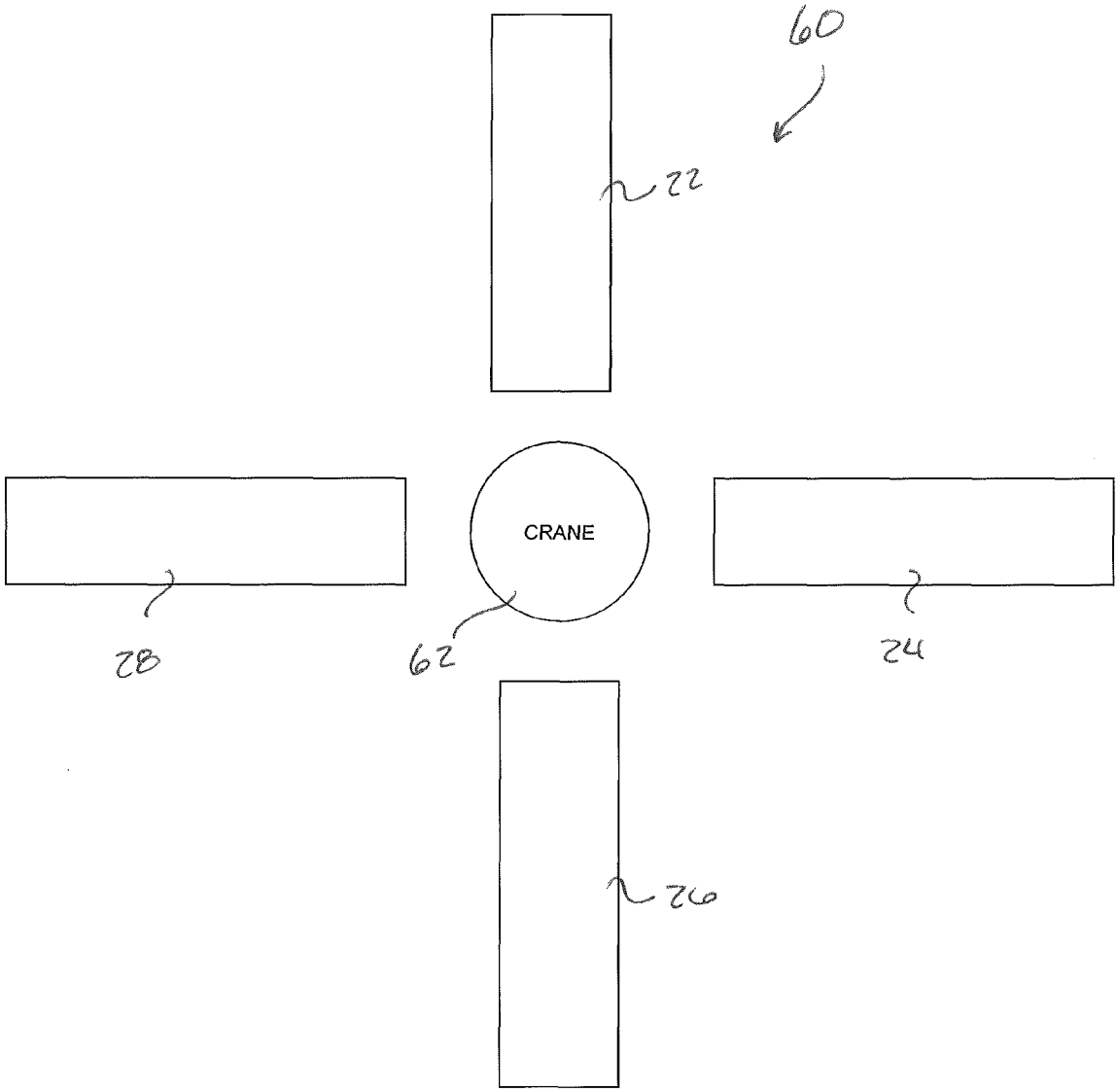
FIG. 6 is a block diagram of a radial construction system and method of constructing layers of a multi-story industrial plant module.

With reference to FIG. 6, an alternative radial fabrication system 60 is illustrated. In this configuration, module layers (e.g., layers 22-28) are arranged around a centrally located crane 62. The layers could be constructed either simultaneously or in a certain sequence. The crane is used to lift and position components and equipment into the layers as required. Once the layers are completed, the crane is used to lift and stack the layers to fabricate the module.

A number of embodiments of the present invention have been described. Nevertheless, it will be understood that various modifications may be made without departing from the spirit and scope of the invention. Accordingly, other embodiments are within the scope of the following claims.

What is claimed is:

1. A method of fabricating modules for industrial plant construction, the method comprising the steps of:

determining a number of single level layers required to fabricate a multi-story industrial plant module, including at least two story layers;

constructing said single level layers at substantially ground level wherein each story layer is constructed to have a skeleton frame open at its top side and free of structural members extending across its top side;

positioning equipment on at least one of said story layers into an installation position of the equipment within said at least one story layer, wherein the equipment is positioned in a downward direction into the installation position from a position directly above the installation position and through said top side; and fabricating said multi-story industrial module after said positioning step by stacking said single level layers and fastening said single level layers together.

2. A method of fabricating modules for industrial plant construction, the method comprising the steps of:

determining a number of single level layers required to fabricate a multi-story industrial plant module, including at least two story layers;

constructing said single level layers at substantially ground level and in a multi-step sequence, where each story layer is constructed to have a skeleton frame open at its top side and free of structural members extending across its top side;

positioning equipment on at least one of said story layers into an installation position of the equipment within said at least one story layer, wherein the equipment is positioned in a downward direction into the installation position from a position directly above the installation position and through said top side; and fabricating said multi-story industrial module after said positioning step by stacking said single level layers and fastening said single level layers together.

3. The method of claim 2, wherein said constructing step includes each single level layer is constructed in a linear construction method.

4. The method of claim 2, wherein said constructing step includes each single level layer is constructed in a radial construction method.

5. The method of claim 2, wherein said constructing step is performed substantially within a building facility.

6. The method of claim 2, wherein said constructing step includes each single level layer being constructed before said fabricating step.

7. The method of claim 2, wherein said constructing step includes equipment installed on each story layer before said fabricating step.

8. A method of fabricating modules for industrial plant construction, the method comprising the steps of:

determining a number of single level layers required to fabricate a multi-story industrial plant module, including at least two story layers;

constructing each single level layer at substantially ground level in a building facility and in a multi-step sequence, where each story layer is constructed to have a skeleton frame open at its top side and free of structural members extending across its top side;

positioning equipment on at least one of said story layers into an installation position of the equipment within said at least one story layer, wherein the equipment is positioned in a downward direction into the installation position from a position directly above the installation position and through said top side; and fabricating said multi-story industrial module after said positioning step by stacking said single level layers and fastening said single level layers.

9. The method of claim 8, wherein said constructing step includes each single level layer is constructed in a linear construction method.

10. The method of claim 8, wherein said constructing step includes each single level layer is constructed in a radial construction method.

* * * * *